US005683268A

United States Patent [19]

Drach et al.

[11] Patent Number: 5,683,268

[45] Date of Patent: Nov. 4, 1997

[54] UNIVERSAL STACKING MODULAR SPLICING CONNECTOR

[75] Inventors: Robert G. Drach; Kar Lan Kam, both of Omaha, Nebr.

[73] Assignee: Lucent Technologies Inc., Murray Hill, N.J.

[21] Appl. No.: 580,731

[22] Filed: Dec. 27, 1995

[51] Int. Cl.[6] ..... H01R 4/26

[52] U.S. Cl. ..... 439/404

[58] Field of Search ..... 439/403–405, 439/395, 723, 725

[56] References Cited

U.S. PATENT DOCUMENTS

| | | | |
|---|---|---|---|
| 3,496,522 | 2/1970 | Ellis, Jr. et al. | 439/403 |
| 3,611,264 | 10/1971 | Ellis, Jr. et al. | 439/403 |
| 3,772,635 | 11/1973 | Frey et al. | 439/403 |
| 3,858,158 | 12/1974 | Henn et al. | 439/403 |
| 4,106,838 | 8/1978 | Jayne et al. | 439/404 |
| 4,127,312 | 11/1978 | Fleischhacker | 439/403 |
| 4,148,138 | 4/1979 | Becker et al. | 29/749 |
| 4,282,644 | 8/1981 | Petree | 29/566.3 |
| 4,384,402 | 5/1983 | Petree | 29/749 |
| 4,533,200 | 8/1985 | Wilson | 439/395 |
| 4,552,429 | 11/1985 | Van Alst | 439/404 |
| 5,122,077 | 6/1992 | Maejima et al. | 439/404 |
| 5,205,033 | 4/1993 | Drach | 29/749 |
| 5,309,635 | 5/1994 | Drach | 29/863 |
| 5,314,350 | 5/1994 | Matthews et al. | 439/404 |

*Primary Examiner*—David L. Pirlot
*Assistant Examiner*—Brian J. Biggi

[57] ABSTRACT

A stackable splice module adapted to engage and mount to additional stackable splice modules to form an electrical connector for pairs of wires, the stackable splice module including an upper portion and a lower portion. A series of indexing teeth are formed along the length of the upper portion, defining wire receiving passages therebetween. Contact elements are mounted within the stackable splice modules, each having an upper end that projects into the teeth of the upper portion of its stackable splice module. The contact elements each include a wire receiving slot aligned with a wire receiving passage of the upper portion and which engages in the insulated wires to establish contact therewith. Lower ends of each contact element project into the lower portions of the splice modules and each include contact slots adapted to engage and receive a contact member of an upper end of a contact element of an additional splice module being stacked thereunder.

13 Claims, 5 Drawing Sheets

UNIVERSAL STACKING MODULAR SPLICING CONNECTOR

FIELD OF THE INVENTION

The present invention relates in general to splice module connectors for electrical pairs. In particular, the present invention relates to a universal stacking splice module for connecting twisted wire pair groups, which is stackable to connect additional wire pairs and to enable increased consistency of contact between the connector elements thereof.

BACKGROUND OF THE INVENTION

It has been estimated that well over two billion splice connections between communications cables are made each year in the communications industry. Due to use requirements being placed on communications systems today, multiple contact connectors or splice modules generally have become the standard for wire splice connections. At this time, two of the leading connectors or splice modules for 25 pair groups, and other size wire pair groups, are the 3M® 4000 Series Connector and the AT&T 710 Series Connector.

U.S. Pat. Nos. 3,772,635 of Frey et al. and 3,858,158 of Henn et al. generally disclose the AT&T 710 Series multiple contact splice module. This splice module or connector includes an index strip to which a connector module attaches. Contact elements are mounted within the connector module and each include conductor receiving slots formed in their upper and lower ends, in which the wires of the wire pairs are received. A first group of wires is inserted within grooves or rests formed in the index strip, and the connector module is placed thereover with the wires received within the lower slots of the contact elements. A second group of wires is placed within the upper slots of the contact elements of the connector module to form the splice between the upper and lower wire groups.

The primary problem with such splice modules is that they generally are limited in the number of wire pairs that can be connected by the size of the splice module as such splice modules are not stackable. Typically, these connectors cannot accommodate the attachment of additional wire pairs or groups without requiring an additional bridge connector to attach a third group thereto. The attachment of further groups of wires in addition to the group attached by the bridge connector generally is not permitted. Further, the construction of conventional multiple connection splice modules, as shown in the aforementioned Pat. Nos. 3,772,635 and 3,858,158 includes several separate elements that must be attached together to form the splice module. The 3M® Connector 4000 Series splice module is designed to be stackable for connecting multiple pairs of wires, but like the AT&T 710 splice module, is formed from numerous pans, including internally mounted wire cutoff blades. Such constructions are expensive to produce, as each element must be manufactured separately, and generally are expensive and difficult to install in the field.

Additionally, special tools are required for assembling and attaching the several elements of conventional splice modules. For example, with the 3M® Connector 4000 Series splice module a separate assembly tool is required to hold the wires in place until the splice modules can be assembled together to form the connector. Thus, additional tools and time are required to hold the wires and assemble the 3M® splice module, limiting the number of splice connections that can be made within a desired time. Examples of assembly tools for conventional splice modules are shown in U.S. Pat. Nos. 5,205,033 of Drach, 5,309,635 of Draeh and 4,384,402 of Petree. As shown in these references, the tools for assembling conventional splice modules generally are bulky and often are difficult to use and require significant physical exertion to complete the attachment of the elements of the splice modules. Special tools for performing single specific tasks further add to the accumulation of tools in an installer's tool kit, and can be easily damaged or lost. Thus, the necessity of using such special tools adds to the complexity and to the time and cost required to complete the splice connections.

Accordingly, it can be seen that a need exists for a multiple connection splice module that enables additional groups of wire pairs to be connected in series without requiring additional bridge elements and which is inexpensive and easy to manufacture and assemble in the field without requiring specialty attachment tools.

SUMMARY OF THE INVENTION

Briefly described, the present invention comprises a splice module for forming a connector for connecting pairs of cables or wires, such as telephone transmission lines, in series. The stacking splice module of the invention generally includes a module body formed from a rigid, durable plastic or similar material and having an upper portion and a lower portion. A series of upwardly projecting indexing teeth are formed along the length of the upper portion of the module body, The indexing teeth include wire pair splitters or separators positioned at spaced intervals along the length of the module body, and a series of spacers positioned between the wire splitters. The wire splitters and spacers are spaced so as to define a series of wire receiving passages or slots therebetween.

The upper portion of each module body further includes a proximal ledge and a distal ledge positioned on opposite sides of the indexing teeth. The proximal ledge generally is slightly wider than the distal ledge, and includes a substantially flat, longitudinally extending anvil or wire cut-off portion extending adjacent the indexing teeth. The wire cut-off portion provides a means against which the wires extended through the wire receiving passages can be engaged and cut-off or "dead-ended" to a uniform length. The distal ledge of the upper portion of the module body includes a series of recessed wire receiving depressions, each aligned with a wire receiving passage. The wires are received and seated within the wire receiving depressions to avoid interfering with the stacking of the splice modules. Additionally, a series of latch openings are formed in the proximal and distal ledges at spaced intervals along the length of the upper portion.

The lower portion of the module body has a substantially inverted U-shaped cross-section. The lower portion includes a pair of parallel side latch members that project downwardly therefrom. The side walls define a substantially inverted U-shaped clearance cavity within the lower portion. A series of detents or staffers are formed inwardly of the latch members of the lower portion, on each side thereof. Thus, when two identical modules are stacked, the detents engage and push the wires received in the wire receiving passages of the upper portions of the lower stacking splice module received within the clearance cavity of the lower portion of the module body. As a result, the wires are urged or stuffed into a seated position within the wire receiving slots by the connection of the modules without the necessity of specialized tools and extra action by the installer to seat the wires before connecting the modules. Contact receiving cavities are formed between the detents, with the shape of the cavities corresponding to the shape of either a spacer or wire splitter for receiving the spacers and wire splitters of a stacking splice module to be stacked thereunder. Additionally, the latch members formed along the side walls of the lower portion are adapted to engage the latch openings formed along the upper portion of an additional splice module for locking the splice modules together in a stacked alignment to form the connector.

The splice modules further include conductive means mounted therein for engaging and making electrical contact with the wires to be spliced to form the splice connection between the pairs of wires. The conductive means generally includes a contact element formed from phosphor bronze or a similar metal material. The contact element includes an upper end having a wire receiving slot formed therein and extending downwardly along an intermediate portion of the length of the contact, and a lower end. The upper end further includes a wire retention member having a barbed or hooked upper end, having one side leg of the upper end, and a male stacking contact having a contact member projecting upwardly therefrom, and extending substantially parallel to the wire retention member and forming the second leg of the upper end. The wire retention member and the stacking contact member are spaced apart so as to form the upper wire receiving slot therein, and are yieldable horizontally. As a result, as an insulated wire having a diameter slightly greater than the width of the upper wire receiving slot is moved along the upper wire receiving slot, the retention and contact members bear against the sides of the wire, cutting through the insulation thereabout to engage the wire in electrical contact therewith.

The lower end of each contact member includes a pair of spaced, downwardly extending contact legs or members. The contact legs define an inverted, substantially U-shaped female contact slot, which is positioned within the contact receiving cavity of the lower portion of the stacking splice module. The male stacking contacts are guided into engagement with the contact slot by the receipt of the indexing teeth of the lower splice module within the contact receiving cavities of the upper splice module. Thus, as the splice module is stacked over an additional splice module, the male stacking contacts of the contact elements of the additional, lower splice module are received within the female contact slot and engage the contact legs. Such engagement forms an electrical contact to complete the splice between the pairs of wires of the upper and lower stacked splice modules.

It will be understood that various objects, features and advantages of the present invention will become known to one of ordinary skill in the art upon reading the following specification, when taken in conjunction with the accompanying drawings.

DETAILED DESCRIPTION OF THE EMBODIMENT

Figure 1:
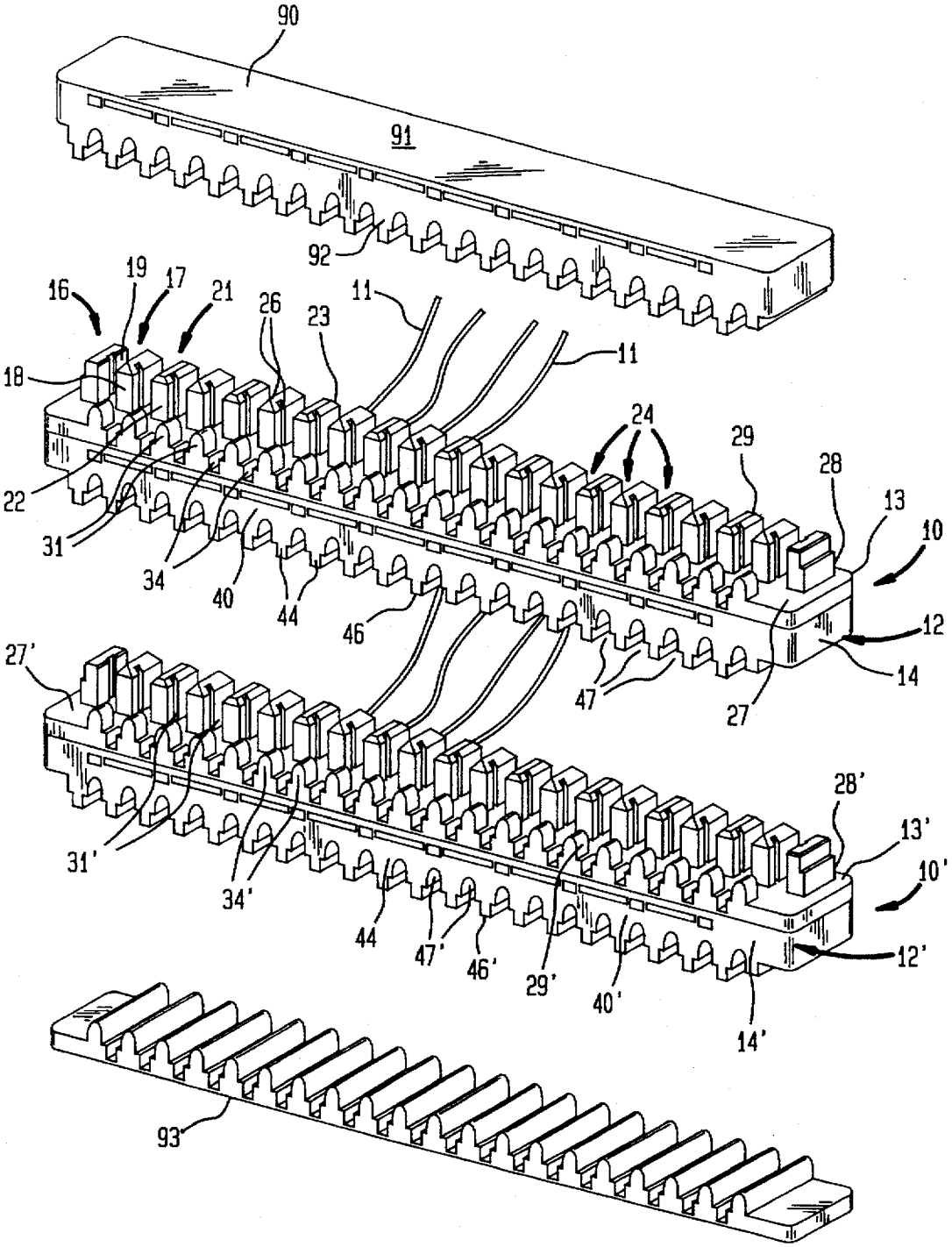
FIG. 1 is an exploded perspective view of stacking splice modules of the present invention, illustrating the stacking thereof.
Figure 2:
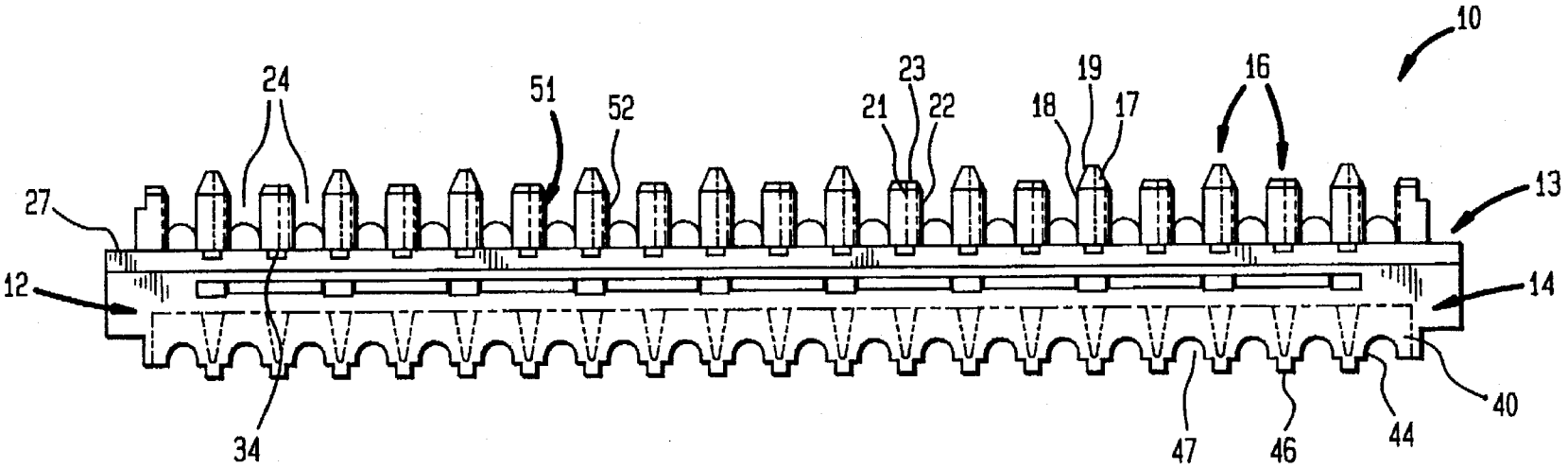
FIG. 2 is a side elevational view of a stacking splice module of the present invention.
Figure 3:
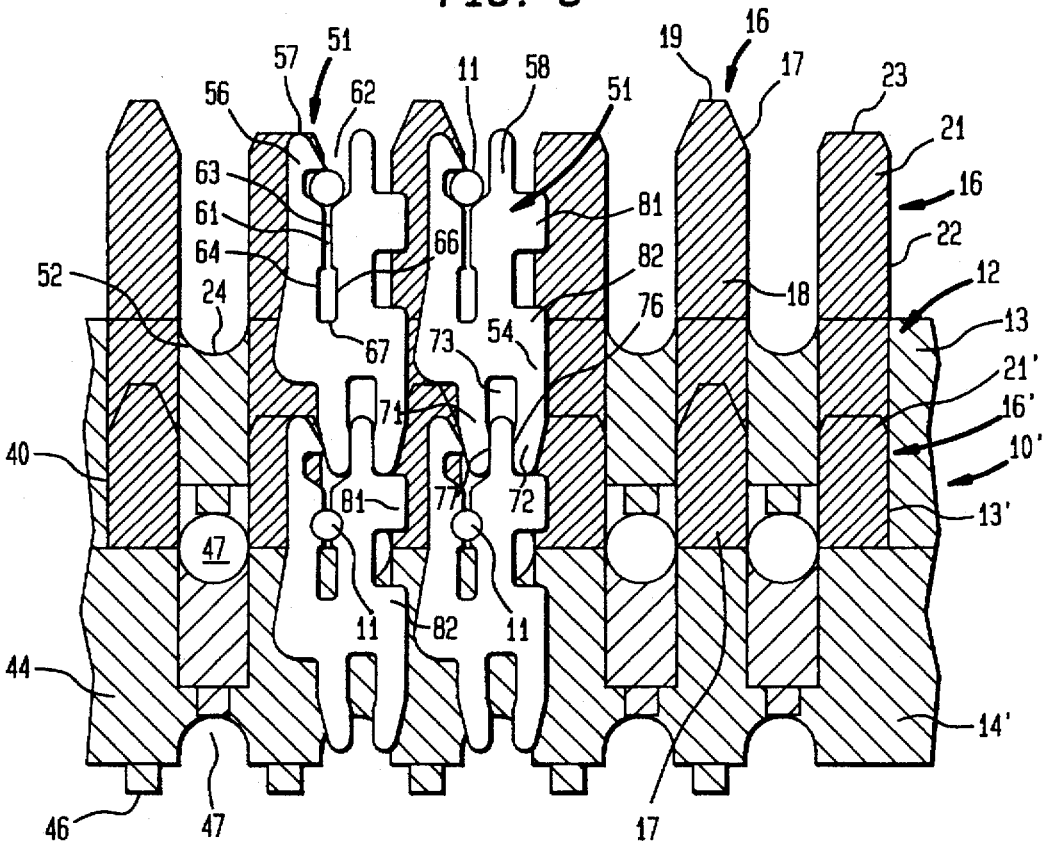
FIG. 3 is a cross-sectional view of a portion of a pair of stacked splice modules.

Referring now in greater detail to the drawings in which like numerals indicate like parts throughout the several views, FIGS. 1, 2 and 3 illustrate a stacking splice module 10 for forming a connector for connecting insulated wires 11, such as a solid copper telephone transmission cables, arranged in pairs or groups of wires. As illustrated in FIG. 1, the pairs of wires are spaced along the length of the stackable splice module 10, with the spacing optimally being approximately 0.150 inches between the insulated wires of each pair. Each splice module 10 includes a module body having an upper portion 13 and a lower portion 14.

Figure 4A:
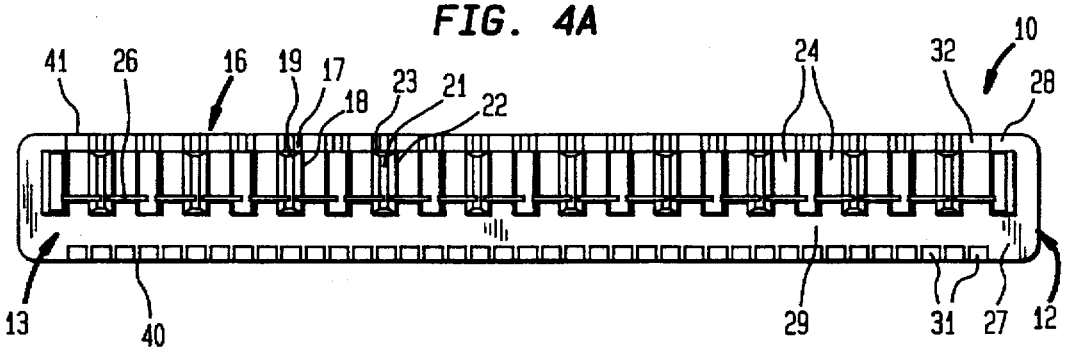
FIG. 4A is a top plan view of the stacking splice module.

As illustrated in FIGS. 1, 2, and 3, the upper portion 13 includes a series of upwardly projecting indexing teeth 16 formed at spaced intervals along the length of the upper portion. The indexing teeth include a series of wire splitters 17 each of which have a rectangular body portion 18 and a pointed upper end 19. Spacers 21 are formed between the wire splitters 17 at spaced intervals along the length of the upper portion 13 of the module body 12. As FIGS. 2 and 3 illustrate, each of the spacers has a substantially rectangular body 22 and a flat upper end 23. As illustrated in FIGS. 1 and 4A, the wire splitters and spacers define a series of wire receiving passages 24 therebetween. The wire receiving passages generally are semi-cylindrically shaped depressions and can be formed in varying sizes depending upon the size of the wires to be received therein. The pairs of wires 11 (FIG. 1) are received and held within the wire receiving slots formed between the wire splitters and spacers. Additionally, a series of contact receiving channels or slits 26 are formed through the bodies 18 and 22 of each pair of wire splitters 17 and spacers 21 for receiving a conductive means therein. The contact receiving channels 26 are formed along the longitudinal axis of the module body, extending transversely across the wire receiving passages 24, as shown in FIG. 4A.

As shown in FIGS. 1 and 4A, the upper portion 13 of each module body 12 includes a proximal side ledge 27 and a distal side ledge 28. The proximal and distal side ledges 27 and 28 extend along the length of the module body parallel to one another, and are positioned on opposite sides of the wire splitters 17 and spacers 21. The proximal side ledge 27 generally has a slightly greater width than the distal side ledge 18, and includes a flat, wire cut-off portion or anvil 29. As FIG. 4A illustrates, the wire cut-off portion is formed immediately adjacent the wire splitters and spacers and is elevated slightly above the wire receiving passages 24 formed between the wire splitters and spacers. The wire cut-off portion forms a line along which and a means against which the wires received and seated within the wire receiving passages can be engaged and cut-off to a uniform length by the connecting tool or a cutting knife moving along the length of the wire cut-off portion from left to right.

A series of wire sealing clearances 31 are formed along the outer edge of the wire cut-off portion 29, aligned with the wire receiving passages 24 of each module body. Similarly, the distal side ledge 28 of the module body includes a series of wire receiving clearances 32 for receiving and seating the wires to be spliced therein. The wire receiving clearances 31 and 32 of the proximal and distal ledges are aligned and thus formed part of the wire receiving passages 24 of each module body 12. In splicing operations where the wires are not dead-ended at the splice, but rather are continued through the splice module, or when forming a half-tap splice, the wires are received within the wire receiving clearances to maintain the wires in a secure, seated alignment when the splice modules are stacked together.

Figure 4B:
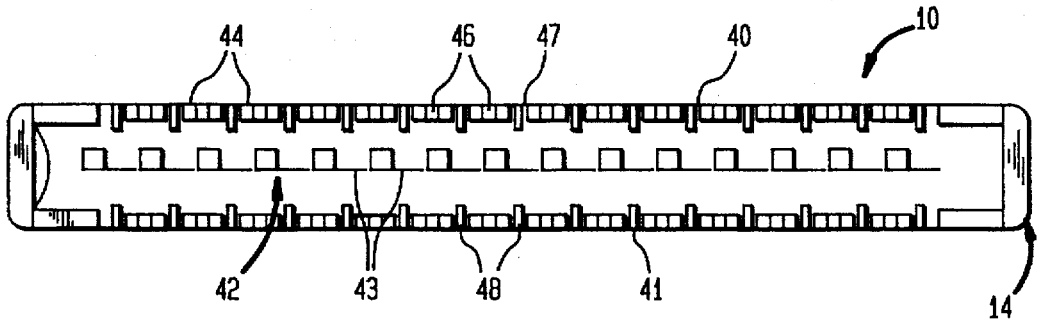
FIG. 4B is a bottom view of the stacking splice module.

As illustrated in FIGS. 1 and 4B, the lower portion 14 of each module body 12 generally is substantially rectangularly shaped and includes a proximal side wall 40 and a distal side wall 41. A proximal and distal side walls extend longitudinally along the length of the module body, and are positioned substantially parallel to one another, thus defining a clearance cavity 42 (FIG. 4B) within the lower portion of the module body. The clearance cavity is adapted to receive the upper portion 13' (FIG. 1) of an additional stackable splice module 10' when the stackable splice modules are stacked one on top of another. Additionally, a series of contact receiving cavities 43 (FIG. 4B) are formed in the lower portion at spaced intervals along the clearance cavity 42, formed at each contact position for receiving the conductive means of the lower, additional stackable splice module 10' (FIG. 1) being seated therewithin.

The proximal and distal side walls 40 and 41 of the lower portion further include a series of spaced latch members 44 (FIG. 2) formed therein. Each of the latch members comprises a downwardly projecting leg having a locking tab 46 formed at its lower end. The locking tabs 46 of the latch members 44 are adapted to engage and be seated within the latch openings 34 formed in the proximal and distal side ledges 27 and 28 of the upper portion 13 of each module body 12. Engagement of the locking tabs 46 within the latch openings 34 locks the stacked splice modules 10 in 10 prime together in a stable, secure arrangement as illustrated in FIGS. 1 and 3.

A series of wire clearance recesses 47 (FIG. 2) are formed in the proximal and distal side walls 40 and 41, formed between the latch members 44. The wire clearance recesses 47 are arched, substantially semi-cylindrical openings or cut-outs formed in the side walls of the lower portion of each module body. As the splice modules are stacked vertically, the wire clearance recesses 47 (FIG. 1) of the lower portion of the module body are aligned with the wire seating clearances 31' and 32' formed along the proximal and distal side ledges 27' and 28' of the upper portion of 13' of the stacked splice module 10' on which the upper stack module 10 is mounted so as to enclose and lock the wires 11 (FIG. 1) therewithin.

Figure 5B:
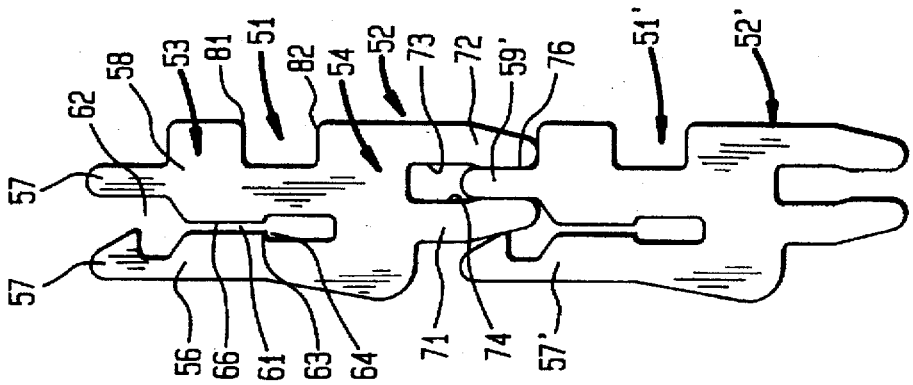
FIG. 5B is a side elevational view of a pair of wire contacts mounted and stacked, contacting engagement.
Figure 5A:
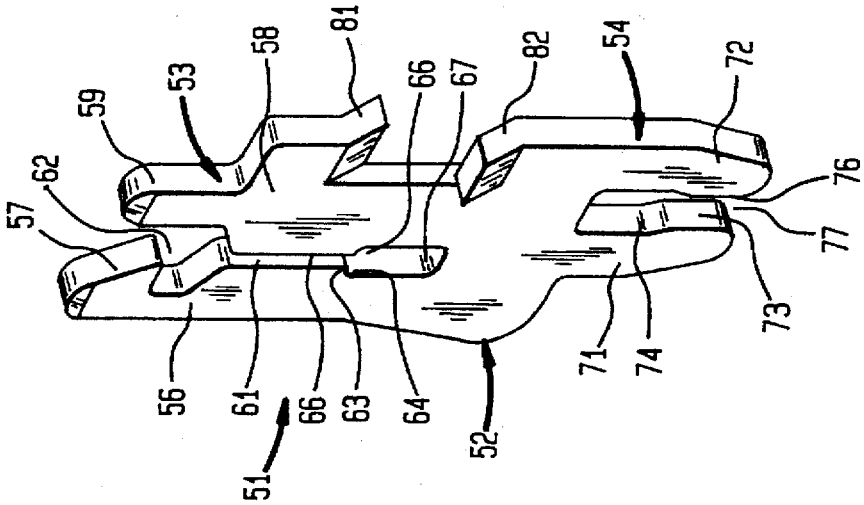
FIG. 5A is a perspective view of the wire contact.

As shown in FIG. 4B, a series of detents or stuffers 48 are formed along the interior of the proximal and distal side walls 40 and 41, extending inwardly into the clearance cavity 42. The detents 48 are aligned with the wire clearance recesses 47 in a position to engage the wires received within the wire receiving passages 24' (FIG. 1) of the lower stacking splice module 10'. Thus, the detents tend to act as a means for urging or stuffing the wires being received in the wire receiving passages of the lower stacking splice module 10'. As a result, the wires automatically are pressed downwardly into a seated contact position as the modules are stacked together, without requiting an additional, specialized assembly tool for compressing the wires into the wire receiving passages prior to stacking the modules. This enables the assembly of the modules in a faster, more efficient manner that requires less steps/actions to complete. As shown in FIGS. 3, 5A and 5B, the conducting means 51 of the splice modules comprise electrical contact elements 52 mounted within the module bodies 12 (FIG. 3) of each stackable splice module 10. The contact elements 52 are formed from phosphor bronze or a similar electrically conductive material and are positioned in series along the length of the module body, extending between the upper and lower portions thereof. The contact elements each include a slotted upper end 53 and a slotted lower end 54. The upper ends 53 of the contact elements are received within the contact receiving channels 26 (FIGS. 1 and 3) formed between the wire splitters 17 and spacers 21. The lower ends 54 (FIG. 3) of the contact elements 52 extend downwardly and through the lower portions of the module body and are received within the contact receiving cavities 43 thereof.

As illustrated in FIGS. 3, 5A and 5B, the upper ends 53 of the contact elements 52 include an upwardly extending wire or tension member 56, which has a hooked upper end 57 adapted to capture and hold a wire in engagement therewith during assembly of the stackable splice modules 10 and 10' and to form the electrical connector, and a contact member 58 having a male stacking contact portion 59 formed at its upper end. The wire retention member 56 and upper contact member 58 define an upper wire receiving slot 61, which generally is aligned with a wire receiving passage 24 (FIG. 3) for receiving and making electrical contact with a wire received through the wire receiving passage. The upper wire receiving slot 61 is an elongated slot having a wide upper cavity 62 in which the wires are received and retained by the hooked end 57 of the wire retention member 56 during the initial assembly of the stackable splice modules, a narrow intermediate portion 63 having side walls 64 and 66, which engage in and cut through the insulation about the wires as the wires slide therealong to a rest position between 64 and 66. A lower wire contact portion or base 67 provides for contact pressure on the seated wires with the insulation surrounding the wires having been pierced and the wires engaging the side walls of the upper wire receiving slot to create an electrical contact between the wires and the contact element.

The lower end 54 of each contact element includes a pair of downward-like extending contact legs 71 and 72 which define a substantially rectangularly shaped slot or female contact portion 73. The contact slot 73 includes a side wall 74 having tapered portions 76 at its open lower end 77 so as to provide an area of reduced or narrowed thickness between the legs 71 and 72. The contact slot receives the male stacking contact portion 59' of a contact number 58' of contact element 52' of a lower stacking splice module, with the tapered portions 76 of the contact legs 71 and 72 engaging the sides of the male stacking contact portion to establish an electrical contact between the contact elements 52 and 52' as illustrated in FIG. 5B.

As illustrated in FIG. 5A, retention tabs 81 and 82 are formed along the right side of each contact element 52, with the upper retention tab 81 being formed adjacent and slightly below the male contact portion 59 of contact member 58, and when the lower retention tab 82 formed above contact leg 72. The retention tabs are canted at a slight angle with respect to the upper and lower ends of the contact elements, forming off-sets or locking means for securing the contact elements within the module bodies. When the contact elements are received within the contact receiving slits 26 (FIG. 1) of the module body 12 of each stackable splice module 10, the retention tabs tend to engage the sides of the contact receiving slits to lock the contact elements within the module body within each splice module and prevent the contact elements from being pushed or pulled through the module body when the wires to be spliced are mounted therein. The upper retention tab 81 (FIG. 5A) further acts as a means for aligning the male stacking contact portion 59 of the contact element for engagement with the contact slot 73 of its mating contact element by securing the upper end of the contact element in a desired orientation within the upper portion of the module body.

Figure 6:
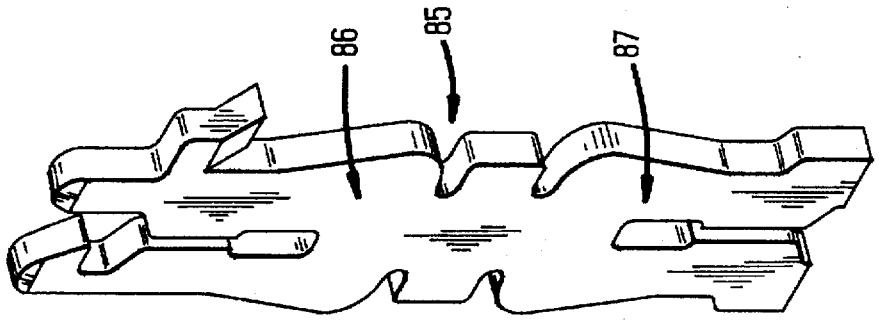
FIG. 6 is a prospective illustration of an additional embodiment of the electrical wire contact.

FIG. 6 illustrates an additional embodiment of the contact element 90 for use in providing a basic splice to enable stacking over pre-locked pairs of wires. The contact element 85 includes an upper end 86 having substantially the same configuration as the upper ends of the contact elements 52 (FIGS. 5A and 5B) generally used with the stackable splice module. Contact element 85 (FIG. 6) however, includes a lower end 87 that generally is formed with a substantially mirror configuration as its upper end 86 for engaging a wire without being capable of stacking on additional splice modules, for creating a simple, straight splice without stacking.

As shown in FIG. 1, an upper cap 90 is adapted to be received over the upper most stackable splice module 10 for sealing the upper portion 13 of the module body 12 thereof. The upper cap generally is formed with a substantially flat upper surface 91 and with a lower or base portion 92 having a configuration substantially equivalent to a lower portion 14 of each stackable splice 10 to enable the cap to be fitted over and locked in place over the upper portion of the upper stackable splice module. Similarly, a base or bottom cap 93 is adapted to be received under the lower most stackable splice module 10' for sealing the bottom of the stackable splice module. The bottom cap is received within the lower portion of 13' of stackable splice module 10' in a locked, seated relationship to complete the construction of the splice module.

Figure 7:
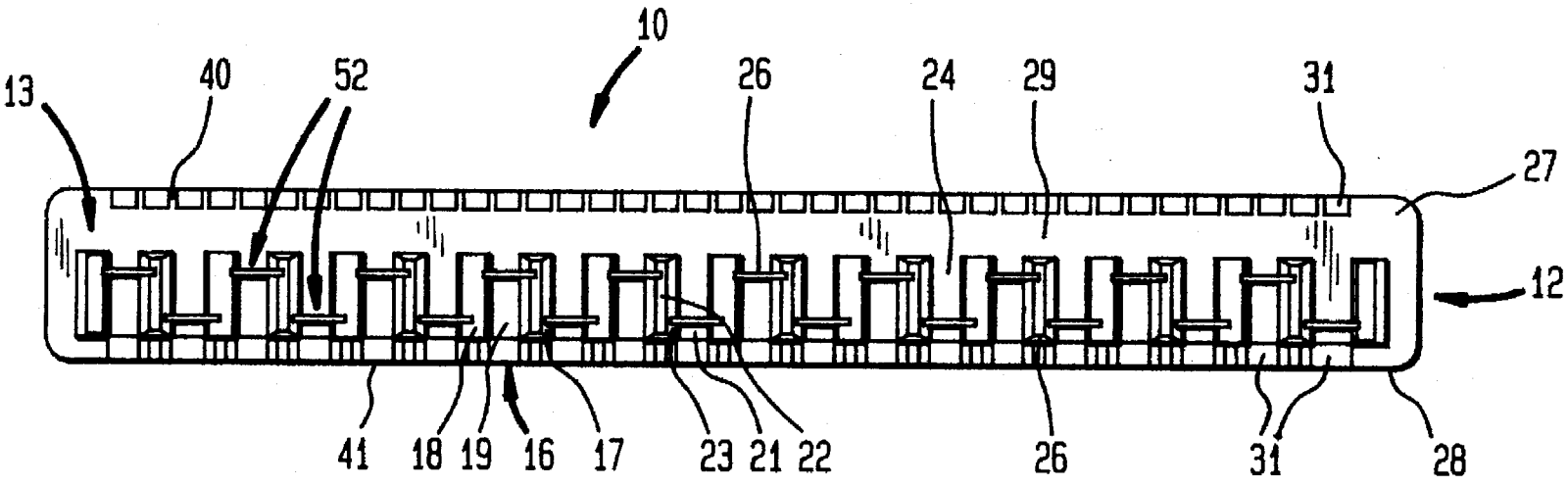
FIG. 7 is a bottom view of an alternate embodiment of the splice module.

FIG. 7 illustrates an additional embodiment of the stacking splice module of the present invention in which the contact elements 52 are mounted within the body of the module in an alternating, staggered arrangement. Accordingly, the contact receiving channels 26 are formed in alternating, parallel planes along the length of the module body as illustrated in FIG. 7 so that the contact elements are spaced apart slightly across the width of the module body instead of being substantially aligned in the same plane along the length of the module body. Such a construction enables the overall length of the module body to be reduced as the contact elements can be positioned so as to overlap one another slightly without interfering with one another, and the cross-talk transmission properties of the connector further can be enhanced significantly.

In installation and use of the stackable splice module for forming an electrical connector for connecting pairs of telephone transmission wires 11 (FIG. 1), the wires 11 typically are arranged in pairs of between 5 to 25 pairs, with each wire of each pair being positioned over and received within a wire receiving passage 24 of the upper portion 13 of the module body of a stackable splice module 10. The wires generally are pressed into the upper cavities 62 (FIGS. 3 and 5A) of the contact elements 52 by hand, with the wires being engaged and held within the upper cavities by the hooked upper ends 57 of the wire retention members of the contact elements. The hooked ends of the wire retention members thus hold the wires in place within the upper ends of the wire receiving passages of the stackable splice modules during assembly without requiring any special tools or a jig, etc. for holding the wires in place and preventing wires from slipping or being pulled from the wire receiving passages during assembly of the connector.

Once all of the wires have been positioned in their desired wire receiving passages, the wires automatically are urged downwardly along the upper wire receiving slots 61 of the contact elements 52 either by the use of a clamping tool or by the engagement of the detents 48 (FIG. 3) of the upper stacking splice modules, instead of the installer having to use a special tool to seat the wires prior to stacking the modules. As the wires slide downwardly along the intermediate portions 63 of the wire receiving slot 61, the walls 64 and 66 of the wire receiving slots cut through the insulation and engage the copper or other metal wire or encased within the insulation. As a result, an electrical contact is established between the wires and the contact elements.

In performing a conventional dead-ended splice, the wires typically are pressed down into the wire contact portions 67 of the wire receiving slots of the contact elements by an assembly tool. The assembly tool additionally engages the wires against the wire cut-off portion 29 of the proximal side ledge 27 of the upper end of the module body and severs the wires substantially, uniformly with their ends immediately adjacent the wire splitters and spacers. Additionally, the wires can be cut-off either with the assembly tool or by moving a cutting knife from left to right with the wires being held in place by the engagement of the assembly tool with the stacking splice module.

If the wires are to be continued through the stackable splice module, for example, in forming a half-tap splice, the wires are left uncut. The depressing of the wires into the wire contact portions of the wire contact slots the contact elements under such circumstances generally is accomplished by the engagement of the wires by the detents 48 (FIG. 4B) formed in the lower portion 14 of either the upper cap 90 (FIG. 1) or stackable splice module 10 placed over the wires. As the splice modules 10 and 10' are compressed together into locking engagement, the detents urge the wires downwardly along the wire receiving slots, with the wires being engaged in and held within the wire clearance recesses 47. The wires thus are pressed into the wire contact portions of the contact elements to establish the electrical contact therewith at the same time as the modules are stacked together, without requiring additional steps and specialized tools.

With the wires received within the wire contact portions of the wire receiving slots of the contact elements of the stackable splice modules, the modules are stacked vertically by the positioning and receipt of the upper portion 13' of a lower stacking splice module 10' within the clearance cavity of a lower portion 14' of an upper stacking splice module 10 in the compression of the modules together. As the modules are pressed together, the locking tabs 46 of the latch members of the lower portion of the upper stackable splice module 10 engage and lock into the latch openings 34' formed along the upper portion 13' of the lower stackable splice module 10'. Such locking engagement can be accomplished by a simple pressure means, including a pair of pliers. Thus, special splice tools, etc. are not necessary for the stacking assembly of the splice modules to form the connector. Additionally, as the modules are stacked together, the male contact portions of the contact elements of the lower stackable splice module are received within the contact receiving cavities of the lower portion 14 of the upper stackable splice 10, and are guided into engagement with the female contact portion or slot 73 (FIG. 6B) to establish an electrical contact between the contact elements of the upper and lower splice modules to complete the splice of the pairs of wires held by each stackable splice module.

Once the modules have been locked together with the sealing cap and/or base installed therewith, a sealing grease or gel can be introduced into the modules to seal the modules from ingress by water, etc.

The present invention thus enables the quick and simple splicing of pairs of wires in a vertically stacked arrangement, without substantial limitation on the number of pairs of wires that can be connected. Additionally, the design of the present invention enables the manufacture of a stackable splice module having a one piece construction at a substantially reduced cost, which construction enables the quick and easy assembly of the splice modules together to form a connector without requiring the assembly of multiple parts and which provides excellent connection and splicing characteristics. The present invention also does not require special tools to hold the wires in position while the splice modules are stacked together to form a connector or for stacking an assembly of the splice modules together. Thus, the present invention enables splice connections to be made by installers in the field more easily and with less time required to complete such connections than conventional splice modules or connectors.

It will be understood by those skilled in the art that while the present invention has been disclosed with reference to a preferred embodiment, various additions, modifications, or variations can be made thereto without departing from the spirit and scope of the invention as set forth in the following claims.

We claim:

1. A connector for connecting groups of wires in series, comprising:

a series of stackable splice modules, said series comprised of at least a lower splice module and an upper splice module;

said splice modules each including an upper portion defining a series of wire receiving passages therein, and a lower portion adapted to receive an additional splice module,, in stacking engagement therewith;

conductive means mounted within each of said splice modules each including an upper end defining a wire receiving slot positioned within a wire receiving passage of said upper portion for conductively engaging a wire received therein, and a lower end that projects through said lower portion of said splice module and is adapted to receive and conductively engage an upper end of a conductive means of an additional splice module, said wire receiving slot having a wide upper cavity for receiving and retaining a wire and a narrow intermediate portion which engages and cuts through insulation surrounding the wire to conductively engage the wire;

means on said lower portions for urging wires retained in the wide upper cavities of the wire receiving slots into the narrow intermediate portions of the wire receiving slots; and whereby as said splice modules are stacked atop one another, the wires retained in the wide upper cavities of the wire receiving slots are urged into the narrow intermediate portions of the wire receiving slots and wherein said upper ends of said conductive means of said lower splice module are guided into engagement with said lower ends of said conductive means of said upper splice module to form a connection between the groups of wires.

2. The connector of claim 1 and wherein said conductive means each comprises a double-ended, slotted contact element having a wire retention member and an upper contact member defining said wire receiving slots, and a pair of lower contact members defining a contact slot and adapted to engage an upper contact member of said conductive means of said additional splice module to form an electrical splice connection between said stacked splice modules.

3. The connector of claim 2 and wherein said upper contact member and said wire retention member, are horizontally yieldable so that the movement of an insulated wire of greater diameter than the spacing of said upper contact member and said wire retention member between said upper contact member and said wire retention member causes said upper contact member and said wire retention member to close about and engage the wire through the insulation about the wire.

4. The connector of claim 1 and further including a cap adapted to engage and enclose said upper portion of an uppermost splice module of a stacked splice module assembly.

5. The connector of claim 1 and wherein said lower portion of each splice module includes a plurality of downwardly extending locking members adapted to engage said upper portion of said additional splice module to lock said splice modules in a stacked arrangement.

6. The connector of claim 1 and wherein said upper portion includes a series of spaced wire splitters and a series of spacers positioned between adjacent wire splitters.

7. The connector of claim 1 and wherein said each conductive means further includes retention tabs adapted to engage said splice members to secure said conductive means within said splice members.

8. The connector of claim 1 and wherein said upper ends of said conductive means each farther includes a contact member adapted to engage a contact slot of a conductive means of a splice module stacked thereover to establish an electrical splice contact between said splice modules and latch members adapted to engage said upper portion of said additional splice module to lock said splice modules in a stacked arrangement.

9. A stackable splice module adapted to mount to additional splice modules in stacked series for connecting pairs of insulated wires together, comprising:

a module body having an upper portion and a lower portion, said upper portion including a plurality of spaced teeth formed along said module body and defining a series of wire receiving passages therebetween, in which the wires are received and held;

a series of conductive means each mounted within said module body in alignment with said wire receiving passages, each conductive means having an upper end that is received and projects through said teeth of said upper portion, said upper end including an upwardly extending contact member and a wire engaging member, said contact member and said wire engaging member defining a wire receiving slot, said wire receiving slot having a wide upper cavity for receiving and holding a wire during assembly of a stacked series of splice modules and a narrow intermediate portion which engages and cuts through insulation surrounding the wire to conductively engage the wire when a stackable splice module of said stacked series of splice modules is stacked atop said module body, said conductive means having a lower end that projects through said lower portion of said module body and includes contact members that define a contact slot adapted to receive and conductively engage an upwardly extending contact member of a conductive means of said additional splice module to connect the pairs of wires held by said stacked series of splice modules together; and means on said lower portion for urging wires in said additional splice module into conductive engagement with said conductive means in said additional splice module, and wherein the wires held in the wide upper cavity are urged into said narrow intermediate portion as said stackable splice module is stacked atop said additional splice module.

10. The splice module of claim 9 and the connector of claim 1 and wherein said each conductive means further includes a series of tension tabs adapted to engage said splice members to secure said conductive means within said splice members.

11. The splice module of claim 9 and the connector of claim 2 and wherein said upper contact member and said wire retention member, are horizontally yieldable so that the movement of an insulated wire of greater diameter than the spacing of said upper contact member and said wire retention member between said upper contact member and said wire retention member causes said upper contact member and said wire retention member to close about and engage the wire through the insulation about the wire.

12. The splice module of claim 9 and the connector of claim 1 and further including a cap module adapted to engage and enclose said upper portion of an uppermost splice module of a stack of splice modules.

13. The splice module of claim 9 and the connector of claim 1 and wherein said lower portion of each splice module includes a plurality of downwardly extending locking members adapted to engage said upper portion of said additional splice module to lock said splice modules in a stacked arrangement.

* * * * *